US005498518A

United States Patent [19]

Brennecke

[11] Patent Number: 5,498,518

[45] Date of Patent: Mar. 12, 1996

[54] CHLORIDE RICH TABULAR GRAIN EMULSION WITH (100) MAJOR FACES

[75] Inventor: Detlef Brennecke, Leichlingen, Belgium

[73] Assignee: Agfa-Gevaert, N.V., Mortsel, Belgium

[21] Appl. No.: 339,701

[22] Filed: Nov. 14, 1994

[30] Foreign Application Priority Data

Nov. 16, 1993 [EP] European Pat. Off. ..... 93203203

[51] Int. Cl.[6] ..... G03C 1/015; G03C 1/035

[52] U.S. Cl. ..... 430/569; 430/567

[58] Field of Search ..... 430/567, 569

[56] References Cited

U.S. PATENT DOCUMENTS 5,015,563 5/1991 Ohya et al. ..... 430/567

5,264,337 11/1993 Maskasky ..... 430/567

5,292,632 3/1994 Maskasky ..... 430/569

5,320,938 6/1994 House et al. ..... 430/569

*Primary Examiner*—Charles L. Bowers, Jr.
*Assistant Examiner*—Mark F. Huff
*Attorney, Agent, or Firm*—Breiner & Breiner

[57] ABSTRACT

A process is disclosed for the preparation of a chloride rich tabular grain emulsion having (100) major crystal faces, characterized in that the precipitation is performed in the presence of a phenylmercaptotetrazole compound.

The scope of the invention further comprises photographic materials comprising an emulsion thus prepared.

4 Claims, No Drawings

CHLORIDE RICH TABULAR GRAIN EMULSION WITH (100) MAJOR FACES

DESCRIPTION

1. Field of the Invention

The present invention relates to a process for the preparation of silver halide tabular grain emulsions rich in chloride having (100) major parallel faces, and to photographic materials containing an emulsion thus prepared.

2. Background of the Invention

High aspect ratio tabular grains exhibit several pronounced photographic advantages. Thanks to their particular morphology greater amounts of spectral sensitizers can be adsorbed per mole silver halide compared to classical globular grains. As a consequence such spectrally sensitized tabular grains show an improved speed-granularity relationship and a wide separation between their blue speed and minus blue speed. Sharpness of photographic images can be improved using tabular grains thanks to their lower light scattering properties again compared to conventional globular emulsion grains. In color negative materials the conventional sequence of the light sensitive layers can be altered and the yellow filter layer can be omitted. In developed black-and-white images high covering power is obtained even at high hardening levels; alternatively reduced silver halide coverages can be achieved if wanted resulting again in improved sharpness. In double coated radiographic materials the presence of tabular grains reduces the so-called cross-over which is the dominant factor for sharpness in such materials.

The early patent disclosures on high aspect tabular grains, e.g. U.S. Pat. No. 4,434,226, U.S. Pat. No. 4,439,520, U.S. Pat. No. 4,425,425, U.S. Pat. No. 4,425,426 and U.S. Pat. No. 4,433,048 are concerned with high sensitive silver bromide or silver iodobromide emulsions. In these disclosures the obtained tabular grains in their most common form have two (111) triangular or hexagonal opposed major crystal faces. It requires special measures in order to obtain tabular AgBr(I) grains showing parallel (100) major faces. Bogg U.S. Pat. No. 4,063,951 reported the first tabular grain emulsions in which the tabular grains had parallel (100) major crystal faces. The tabular grains of Bogg exhibited square or rectangular major faces, thus lacking the three fold symmetry of conventional tabular grain (111) major crystal faces. Bogg employed an ammoniacal ripening process for preparing the tabular grains, thereby encountering disadvantages such as grain thickening and high pH conditions. In U.S. Pat. No. 4,386,156, an improved process is disclosed by Mignot for the preparation of tabular silver bromide grains bounded by parallel square or rectangular major crystal faces, said process comprising (a) providing a monodisperse silver bromide emulsion containing cubic seed grains having an edge lenght of less than 0.15 μm, and (b) ripening the seed grains in the absence of non-halide silver ion complexing agent to produce tabular grains.

In a lot of photographic applications high sensitivity is of less importance. In these cases the use of chloride rich emulsions is advantageous e.g. thanks to their higher development and fixing rates. Typical examples include graphic arts materials, duplicating materials, hard-copy materials, diffusion transfer reversal materials and black-and-white or color print materials. So it would be interesting to try to combine the advantages of chloride rich emulsions with the advantages of tabular grain structure.

The inclusion in tabular grains of high levels of chloride as opposed to bromide, alone or in combination with iodide, has been difficult. Silver chloride differs from silver bromide in exhibiting a much stronger propensity toward the formation of grains with faces lying in (100) crystallographic planes. Unfortunately, twinning of grains bounded by (100) crystal faces does not produce grains having a tabular shape. To produce successfully a high chloride tabular grain emulsion by twinning, conditions must be found that favor both the formation of twin planes and (111) crystal faces. Further, after the emulsion has been formed, care in subsequent handling must be exercised to avoid reversion of the grains to their favored more stable form exhibiting (100) crystal faces and being non-tabular.

Wey U.S. Pat. No. 4,399,215 produced the first silver chloride high aspect ratio (Equivalent Circular Diameter/thickness>8) tabular grain emulsion. The tabular grains were of the twinned type, exhibiting major faces of three fold symmetry lying in (111) crystallographic planes. An ammoniacal double-jet precipitation technique was employed. The thicknesses of the tabular grains were high compared to contemporaneous silver bromide and bromoiodide tabular grain emulsions because the ammonia ripening agent thickened the tabular grains. To achieve ammonia ripening it was also necessary to precipitate the emulsions at relatively high pH, which is known to produce elevated minimum densities (fog) in high chloride emulsions. Further, to avoid degrading the tabular grain geometries sought both bromide and iodide ions were excluded from the tabular grains early in their formation.

Wey et al U.S. Pat. No. 4,414,306 developed a twinning process for preparing silver chlorobromide emulsions containing up to 40 mole percent chloride based on total silver. This process of preparation has not been successfully extended to high chloride emulsions.

Alternative strategies for producing (111) tabular grains rich in chloride were found in the use of so-called "crystal habit modifiers" or "crystal growth modifiers". So Maskasky U.S. Pat. No. 4,400,463 describes the preparation of a new crystallographic form of tabular silver halide grains rich in chloride by performing the precipitation in the presence of a special peptizer having a thioether linkage and an aminoazaindene growth modifier. Maskasky U.S. Pat. No. 4,713,323 discloses the preparation of thin tabular grains by a precipitation technique wherein oxidized gelatin is used. In a preferred embodiment, illustrated by examples, a growth modifier e.g. an aminoazaindene like adenine is used. Tufano U.S. Pat. No. 4,804,621 describes a process for preparing chloride rich tabular grains in the presence of aminoazapyridine growth modifiers represented by a general formula of which adenine and derivatives are excluded. EP 0 481 133 describes the presence of adenine-like compounds in the preparation of chloride rich tabular grains using conventional gelatin, and Maskasky U.S. Pat. No. 5,183,732 discloses similar compounds. Maskasky further describes triaminopyrimidines in U.S. Pat. No. 5,185,239, xanthine derivatives in U.S. Pat. No. 5,178,998, and other heterocyclic compounds in U.S. Pat. No. 5,178,997, all as growth modifiers in the preparation of chloride rich tabular emulsions.

As stated above the (111) major faces of tabular grains rich in chloride pose a problem of crystallographic stabilty. In EP 0 532 801 it was proposed to introduce a spectral sensitizer before the removal of the crystal growth modifier together with the excess of inorganic salts by a washing process in order to protect the crystallographic habit. In U.S. Pat. No. 5,221,602 the modifier is replaced after precipitation for the same purpose by a compound having a divalent sulphur group, preferably a cyanine dye with a thioether group. However since these methods are cumbersome methods were sought for the preparation of tabular grains rich in chloride having (100) major faces. One such a method was disclosed in EP 0 534 395 comprising essentially a nucleation step in the presence of iodide, and a pCl of the dispersing medium maintained between 0.5 and 3.5.

It is an object of the present invention to provide an alternative process for the preparation of tabular grains rich in chloride having (100) major crystal faces.

It is a further object of the present invention to provide a process for the preparation of a chloride rich tabular grain emulsion with excellent crystallographic stabilty.

It is still a further object of the present invention to provide a process for the preparation of a tabular grain emulsion rich in chloride with improved sensitometric characteristics, especially sensitivity, compared to equivalent non-tabular cubic emulsion grains.

It is still a further object of the present invention to provide a photographic material containing a tabular grain emulsion thus prepared.

SUMMARY OF THE INVENTION

The objects of the present invention are realized by providing a process for the preparation of a silver halide tabular grain emulsion, containing at least 50 mole % of chloride, wherein at least 50% of the total projected area of all the grains is provided by said tabular grains, and wherein said tabular grains exhibit an average aspect ratio of at least 2:1, an average thickness not greater than 0.5 micron, an average equivalent sphere diameter of at least 0.2 micron, and wherein said tabular grains have (100) major faces, characterized in that the precipitation is performed in the presence of a phenylmercaptotetrazole compound.

Unexpectedly a tabular grain emulsion rich in chloride showing high gradation, sensitivity and covering power was obtained.

DETAILED DESCRIPTION OF THE INVENTION

In a preferred embodiment of the present invention the chloride content is at least 90 mole %, and in a most preferred embodiment the emulsion is pure silver chloride.

Although the precipitation for the formation of the tabular grains of present invention can be principally performed by one double jet step it is preferred to perform a sequence of a nucleation step and at least one growth step. Of the total silver precipitated preferably 0.5% to 5.0% is added during said nucleation step which consists preferably of an approximately equimolecular addition of silver and halide salts. The rest of the silver and halide salts is added during one or more consecutive double jet growth steps under precipitation conditions favouring the formation of tabular chloride rich grains as defined above. The different steps of the precipitation can be alternated by physical ripening steps. During the growth step(s) an increasing flow rate of silver and halide solutions is preferably established, e.g. a linearly increasing flow rate. Typically the flow rate at the end is about 3 to 5 times greater then at the start of the growth step. These flow rates can be monitored by e.g. magnetic valves. In a preferred embodiment the pCl is maintained between 1.0 and 2.0, preferably between 1.0 and 1.5 during the different stages of the precipitation, and the pH is maintained between 4.0 and 9.0, preferably between 5.5 and 7.0.

The phenylmercaptotetrazole compound can be added in principle at any stage of the emulsion preparation but for a most successful execution of the present invention it is added preferably at an early stage of the preparation. Most preferably it is added to the dispersion medium before the actual start of the precipitation.

Useful phenylmercaptotetrazole compounds for use in accordance with the present invention include following substances:

PMT-1

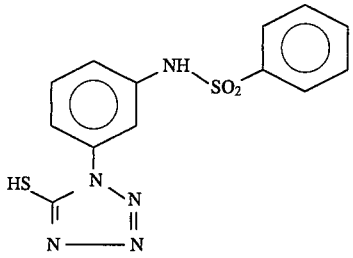

PMT-2

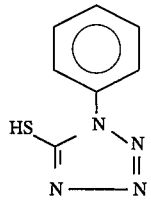

PMT-3

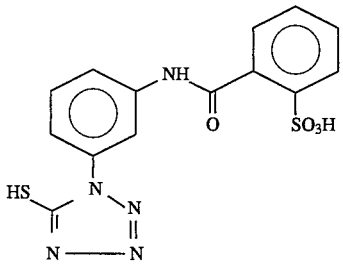

PMT-4

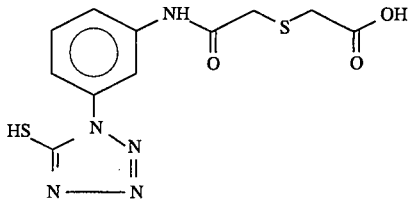

PMT-5

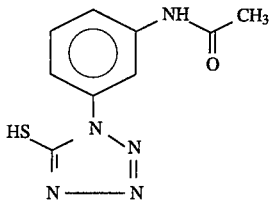

PMT-6

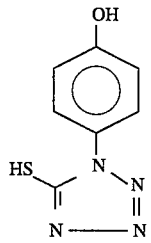

-continued

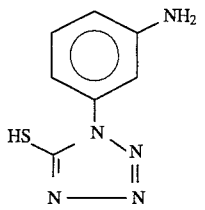

PMT-7

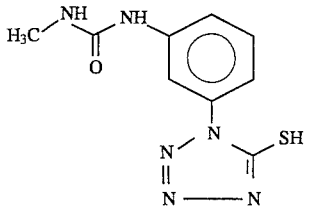

PMT-8

The phenylmercaptotetrazole compound used is added in an amount preferably ranging from $10^{-4}$ mole to $10^{-2}$ mole per mole of total silver halide precipitated, and most preferably between $5\times10^{-4}$ and $5\times10^{-3}$ mole per mole of silver halide.

After precipitation the emulsion is washed in order to remove soluble inorganic salts. This can be performed by well-known techniques such as repeated flocculation and washing followed by redispersion, or, more preferably, by ultrafiltration.

The tabular silver halide emulsions in connection with the present invention can be chemically sensitized after washing as described e.g. in "Chimie et Physique Photographique" by P. Glafkidés, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners or by means of reductors e.g. tin compounds as described in GB 789,823, amines, hydrazine derivatives, formamidine-sulphinic acids, and silane compounds.

The tabular silver halide emulsions can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in Research Disclosure Item 22534.

In classical emulsion preparation spectral sensitization traditionally follows the completion of chemical sensitization. However, in connection with tabular grains, it is specifically considered that spectral sensitization can occur simultaneously with or even precede completely the chemical sensitization step. For example, Maskasky U.S. Ser. No 431,855, titled CONTROLLED SITE EPITAXIAL SENSITIZATION discloses the chemical sensitization after spectral sensitization at one or more ordered discrete edge sites of tabular grains. This can be done with the tabular chloride rich emulsions prepared according to the method of the present invention.

The photographic tabular grains in connection with the present invention can be used in various types of photographic elements. Because of their chloride rich character they are preferably used for those applications which do not require extreme high sensitivity. Preferred embodiments include graphic arts e.g. recording materials for the ouput of scanners, phototypesetters and imagesetters, duplicating materials, radiographic hard-copy materials, diffusion transfer materials and black-and-white or colour print materials which produce prints starting from negatives in amateur or professional still photography or prints for cinematographic exhibition.

The scope of the present invention further comprises a photographic material containing a tabular emulsion prepared according to the process described.

This photographic material can contain one single emulsion layer, as it is the case for many applications, or it can be built up by two or even more emulsion layers. In the case of color photography the material contains blue, green and red sensitive layers each of which can be single or multiple. Beside the light sensitive emulsion layer(s) the photographic material can contain several non-light sensitive layers, e.g. a protective layer, one or more backing layers, one or more subbing layers, and one or more intermediate layers, e.g. filter layers.

The silver halide emulsion layer(s) of the photographic material in accordance with the present invention or the non-light-sensitive layers may comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion. Suitable examples are e.g. the heterocyclic nitrogen-containing compounds such as benzothiazolium salts, nitroimidazoles, nitrobenzimidazoles, chlorobenzimidazoles, bromobenzimidazoies, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-Appl. 75–39537, and GB 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds are metal salts such as e.g. mercury or cadmium salts and the compounds described in Research Disclosure N° 17643 (1978), Chapter VI.

In the embodiment of a photographic material for colour print purposes, the usual ingredients specific for colour materials can be present e.g. colour couplers, couplers bearing a releasable photographic useful group and scavengers for oxidized developer. These typical ingredients for colour materials can be soluble or added in dispersed form, e.g. with the aid of so-called oilformers or they can be added in polymeric latex form.

The gelatin binder of the photographic element can be hardened with appropriate hardening agents such as those of the epoxide type, those of the ethylenimine type, those of the vinylsulfone type e.g. 1,3-vinylsulphonyl-2-propanol, chromium salts. e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloylhexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in European Patent Application No 90.201850.6

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. U.S. Pat. Nos. 3,038,805, 4,038,075, 4,292,400.

The photographic element of the present invention may further comprise various other additives such as e.g. compounds improving the dimensional stability of the photographic element, UV-absorbers, spacing agents and plasticizers.

Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth) acrylates, sulphoalkyl (meth) acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. No. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455. UV-absorbers are especially useful in colour print materials where they prevent the fading by light of the colour images formed after processing.

Spacing agents can be present of which, in general, the average particle size is comprised between 0.2 and 10 micron. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

As stated above the photographic material can contain several non light sensitive layers, e.g. an anti-stress top layer, one or more backing layers, and one or more intermediate layers eventually containing filter- or antihalation dyes that absorb scattering light and thus promote the image sharpness. Suitable light-absorbing dyes are described in e.g. U.S. Pat. No. 4,092,168, U.S. Pat. No. 4,311,787 and DE 2,453,217. One or more backing layers can be provided at the non-light sensitive side of the support. These layers which can serve as anti-curl layer can contain e.g. matting agents like silica particles, lubricants, antistatic agents, light absorbing dyes, opacifying agents, e.g. titanium oxide and the usual ingredients like hardeners and wetting agents.

The support of the photographic material may be opaque or transparent, e.g. a paper support or resin support. When a paper support is used preference is given to one coated at one or both sides with an Alpha-olefin polymer, e.g. a polyethylene layer which optionally contains an anti-halation dye or pigment. It is also possible to use an organic resin support e.g. cellulose nitrate film, cellulose acetate film, poly(vinyl acetal) film, polystyrene film, poly(ethylene terephthalate) film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material containing tabular grains prepared according to the present invention can be image-wise exposed by any convenient radiation source in accordance with its specific application.

Processing conditions and composition of processing solutions are dependent from the type of photographic material in which the tabular grains prepared according to the present invention are applied. For example, in the preferred embodiment of materials for graphic arts so-called rapid access developers can be used; alternatively so-called lith developers or the more recent "hard dot rapid access" developers can be used depending on the specific composition and use of the photographic element. Preferably an automatically operating processing apparatus is used provided with a system for automatic replenishment of the processing solutions.

The following examples illustrate the invention without however limiting it thereto.

EXAMPLES

1. Examples of emulsion preparation 1.1 : emulsion 1 : cubic AgCl emulsion (control).

To a reaction vessel was added 11 of a dipersion medium that was 5% in bone gelatin and 0.04 M in NaCl. The pH was adjusted to 5.5. Two further solutions were prepared: solution A that was 3 M in $AgNO_3$ and solution B that was 3 M in NaCl. To the stirred reaction vessel content at 60° C. simultaneously were added solution A and solution B with a constant flow rate of 8 ml/min during a period of 5 min. Then solution A was added with accelerated flow rate from 8 ml/min to 33 ml/min over a period of 46 min, so that a total amount of 1000 ml was added. Simultaneously solution B was added in such a way that the pCl was kept constant at 1.3.

The pH was lowered to 3.0 and the coagulated emulsion was coagulated by means of polystryrene sulphonate, and washed 3 times with 4 l of a solution that was 0.015 M in NaCl. The resulting solid phase was resuspended at 45° C. to a total weight of 2.8 kg with a solution that was 7.5% in gelatine and 0,015 M in NaCl. The pH was adjusted to 5.6 and the pAg to 7.3. The resulting emulsion contained 169 g silver per kilogram expressed as $AgNO_3$. This emulsion contained non-tabular cubic high chloride grains with a mean sphere equivalent diameter, defined as the diameter of a hypothetical spherical grain with the same volume as the corresponding cubic grain, of 0.50 micron.

1.2 : emulsion 2: cubic AgClI emulsion (control).

To a reaction vessel was added 11 of a dipersion medium that was 5% in bone gelatin and 0.04 M in NaCl. The pH was adjusted to 5.5. Two further solutions were prepared: solution A that was 3 M in $AgNO_3$ and solution B that was 3 M in NaCl and 0.015 M in KI. To the stirred reaction vessel content at 60° C. simultaneously were added solution A and solution B with a constant flow rate of 8 ml/min during a period of 5 min. Then solution A was added with accelerated flow rate from 8 ml/min to 33 ml/min over a period of 46 min, so that a total volume of 1000 ml was added. Simultaneoully solution B was added in such a way that the pCl was kept constant at 1.3.

The pH was lowered to 3.0 and the emulsion was coagulated by means of polystyrene sulphonate, and washed 3 times with 4 l of a solution that was 0.015 M in NaCl. The resulting solid phase was resuspended at 45° C. to a total weight of 2.8 kg with a solution that was 7.5% in gelatin and 0.015 M in NaCl. The pH was adjusted to 5.0 and the pAg to 7.3. The resulting emulsion contained 169 g silver per kilogram expressed as $AgNO_3$, and the grains contained 0.5 mole % of iodide. This emulsion contained cubic grains with a mean equivalent sphere diameter of 0.50 micron.

1.3 : emulsion 3 : tabular AgCiI grains with (100) major faces (invention).

To a reaction vessel were added 2 l of a dispersion medium that was 0.5% in bone gelatin, 0.15 M in NaCl and 0.001 M in phenylmercaptotetrazole compound PMT-1. The pH was adjusted to 5.5. Two further solutions were prepared : solution A that was 3 M in $AgNO_3$ and solution B that was 3 M in NaCl and 0.015 M in KI. To the stirred reaction vessel content at 45° C. simultaneously were added 10 ml of solution A and 10 ml of solution B during a period of 30 seconds. Then the temperature was rised to 70° C. and held for 15 min. 1 l of a solution that was 6.5% in bone gelatin was added. Solution A was added with accelerated flow rate from 5 ml/min to 25 ml/min over a period of 66 min, so that a total volume of 1000 ml was added. Simultaneouly solution B was added in such a way that the pCl was held constant at 1.3.

The pH was lowered to 3.0 and the emulsion was coagulated by means of polystyrene sulphonate, and washed 3 times with 4 l of a solution that was 0.015 M in NaCl. The resulting solid phase was resuspended at 45° C. to a total weight of 2.8 kg with a solution that was 7.5% in gelatine and 0.015 M in NaCl. The pH was adjusted to 5.0 and the pAg to 7.3. The resulting emulsion contained 175 g silver per kilogram expressed as $AgNO_3$, and the grains contained 0.5 mole % of iodide. This resulting emulsion contained a tabular grain population of 90% of the total projected area of the grains with a mean sphere equivalent diameter of 0.50 micron, a mean thickness of 0.17 micron and an average aspect ratio, defined as the ratio of the diameter of the circle having an area equal to the projected area of the grain as viewed in a photomicrograph and the thickness of the grain, of 4.1. The mean sphere equivalent diameter was defined as the diameter of a hypothetical spherical grain with the same volume as the corresponding tabular grain.

1.4 : emulsion 4 : tabular AgCl grains with (100) major faces (invention).

To a reaction vessel was added 2 l of a dispersion medium that was 0.5% in bone gelatine, 0.15 M in NaCl and 0.001 M in phenylmercaptotetrazole compound PMT-2. The pH was adjusted to 5.5. Two further solutions were prepared: solution A that was 3 M in $AgNO_3$ and solution B that was 3 M in NaCl. To the stirred reaction vessel content at 45° C. simultaneously were added 10 ml of solution A and 10 ml of solution B during a period of 30 sec. Then the temperature was rised to 70° C. and held for 15 min. 1 l of a solution that was 6.5% in bone gelatine was added. Solution A was added with accelerated flow rate from 5 ml/min to 25 ml/min over a period of 66 min, so that a total of 1000 ml of solution A was added. Simultaneouly solution B was added in such a way that the pCl was kept constant at 1.3.

The pH was lowered to 3.0 and the emulsion was coagulated by means of polystyrene sulphonate, and washed 3 times with 4 l of a solution that was 0.015 M in NaCl. The resulting solid phase was resusponded at 45° C. to a total weight of 2,8 kg with a solution that was 7.5% in gelatine and 0.015 M in NaCl. The pH was adjusted to 5.0 and the pAg to 7.3. The resulting pure AgCl emulsion contained 170 g of silver per kilogram expressed as $AgNO_3$. This emulsion contained a tabular grain population of 90% of the total projected area of the grains with a mean sphere equivalent diameter of 0.50 micron, a mean thickness of 0.20 micron and an average aspect ratio of 3.2.

2. Photographic response.

The emulsions from example 1 to 4 were spectrally sensitized with a blue sensitizing dye corresponding to following formula (BS- 1):

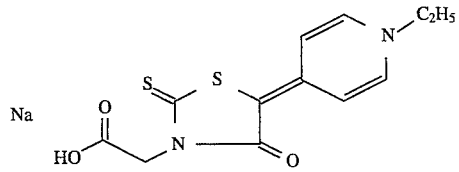

BS-1

Then the emulsions were chemically sensitized with $5.1\times10^{-6}$ mole $Na_2S_2O_3$ per mole Ag, expressed as $AgNO_3$ and $2.4\times10^{-6}$ mole $HAuCl_4.4H_2O$ per mole Ag at 55° C. The emulsions were coated on polyester film support, exposed and processed in a conventional hydroquinone-Phenidone developer. Table 1 shows the sensitometric results. The sensitivity (S) is expressed as relative log H value, higher figure meaning higher sensitivity.

TABLE 1

| Dye BS1 | S (flash exposure) | | | | S (tungsten exposure) | | | |
|---|---|---|---|---|---|---|---|---|
| [mmol/mol Ag] | Em1 Control | Em2 Control | Em3 Invention | Em4 Invention | Em1 Control | Em2 Control | Em3 Invention | Em4 Invention |
| 0.00 | 1.00 | 1.16 | 1.36 | 1.20 | 0.89 | 0.95 | 0.95 | 0.92 |
| 0.17 | 1.30 | 1.42 | 1.49 | 1.36 | 1.12 | 1.25 | 1.25 | 1.21 |
| 0.22 | 1.25 | 1.36 | 1.74 | 1.56 | 1.16 | 1.26 | 1.36 | 1.37 |
| 0.30 | 1.20 | 1.43 | 1.64 | 1.49 | 1.20 | 1.35 | 1.36 | 1.32 |
| 0.40 | 1.12 | 1.40 | 1.49 | 1.42 | 1.16 | 1.30 | 1.36 | 1.32 |
| 0.53 | 0.92 | 1.30 | 1.36 | 1.30 | 1.12 | 1.20 | 1.30 | 1.19 |

It is clear from table 3 that the invention emulsions 3 and 4 show a higher photographic sensitivity than their corresponding comparative emulsions 2 and 1 (comparing the two AgCl, and the two AgClI emulsions mutually) at any concentration of the blue sensitizing dye and for both kinds of exposure.

I claim:

1. Process for the preparation of a silver halide tabular grain emulsion, containing at least 50 mole % chloride, wherein at least 50% of the total projected area of all the grains is provided by said tabular grains, and wherein said tabular grains exhibit an average aspect ratio of at least 2:1, an average thickness not greater than 0.5 micron, an average equivalent sphere diameter of at least 0.2 micron, and wherein said tabular grains have (100) major faces, characterized in that a precipitation is performed in preparing the tabular grain emulsion in presence of a phenylmercaptotetrazole compound wherein said precipitation comprises a nucleation step and a growth step wherein said growth step is performed at a pCl between 1.0 and 2.0.

2. Process according to claim 1 wherein said silver halide tabular grain emulsion contains at least 90 mole % of chloride.

3. Process according to claim 1 wherein said phenylmercaptotetrazole compound is present during the precipitation in a concentration ranging from $10^{-4}$ mole to $10^{-2}$ mole per mole of total silver halide precipitated.

4. Photographic material comprising a support and at least one emulsion layer comprising a silver halide tabular grain emulsion prepared according to a process corresponding to claim 1.

* * * * *